US007249431B1

(12) United States Patent
Rose et al.

(10) Patent No.: US 7,249,431 B1
(45) Date of Patent: Jul. 31, 2007

(54) LIGHT-ACTIVATED ILLUMINATING DEVICE

(76) Inventors: William Rose, 292 Naugatuck Ave., Milford, CT (US) 06460; Dean A. Federici, 24 Arden Rd., Trumbull, CT (US) 06611

( * ) Notice: Subject to any disclaimer, the term of this patent is extended or adjusted under 35 U.S.C. 154(b) by 337 days.

(21) Appl. No.: 10/780,738

(22) Filed: Feb. 19, 2004

(51) Int. Cl.
*G09F 13/20* (2006.01)
*G09F 13/00* (2006.01)

(52) U.S. Cl. ..... 40/543; 250/483.1; 40/542

(58) Field of Classification Search ..... 40/544; 434/410, 84, 85
See application file for complete search history.

(56) References Cited

U.S. PATENT DOCUMENTS

| | | | | |
|---|---|---|---|---|
| 2,516,727 | A | 7/1950 | Schultheiss | |
| 2,632,116 | A | 3/1953 | Bert | |
| 2,654,971 | A * | 10/1953 | Harrison | 40/542 |
| 2,883,770 | A | 4/1959 | Lieb | |
| 3,443,332 | A * | 5/1969 | Christy | 40/544 |
| 4,128,057 | A | 12/1978 | Hayama et al. | |
| 4,139,965 | A | 2/1979 | Curry et al. | |
| 4,237,381 | A | 12/1980 | Schroeder | |
| 4,590,381 | A | 5/1986 | Mendelson | |
| 4,787,852 | A | 11/1988 | Melnick | |
| 5,163,846 | A | 11/1992 | Lee | |
| 5,203,702 | A | 4/1993 | Wilson | |
| 5,324,202 | A | 6/1994 | Meyers et al. | |
| 5,368,489 | A | 11/1994 | Confalone, Jr. et al. | |
| 5,788,359 | A | 8/1998 | Halsey et al. | |
| 6,076,992 | A | 7/2000 | Fukui et al. | |
| 6,099,185 | A | 8/2000 | Huang et al. | |
| 6,113,150 | A | 9/2000 | Kinberg | |
| 6,196,848 | B1 | 3/2001 | Yamazaki | |
| 6,231,204 | B1 | 5/2001 | Lo | |
| 6,441,362 | B1 | 8/2002 | Ogawa | |
| 6,585,388 | B2 | 7/2003 | Kim | |
| 6,595,826 | B2 | 7/2003 | Koizumi | |
| 6,641,280 | B2 | 11/2003 | Hanson et al. | |
| 2004/0076460 | A1 * | 4/2004 | Yu et al. | 401/1 |

* cited by examiner

*Primary Examiner*—Cassandra Davis
(74) *Attorney, Agent, or Firm*—DeLio & Peterson, LLC; Peter W. Peterson

(57) ABSTRACT

A light-activated illuminating member having a support member and a phosphorescent material supported thereby. The phosphorescent material can form a luminescent image having a varying luminescent effect after the phosphorescent material is exposed to a light of constant intensity. One or more such light-activated illuminating members can be assembled with a light source, such as a UV-LED pen, and be formed into a book-type writing/drawing toy which is capable of providing a varying luminescent effect. When a plurality of such illuminating members are used in the book-type toy, such a toy is capable of providing a different, combined luminescent effect.

14 Claims, 4 Drawing Sheets

LIGHT-ACTIVATED ILLUMINATING DEVICE

FIELD OF THE INVENTION

The present invention relates generally to a light-activated illuminating device. In particular, the present invention provides a luminescent device capable of forming a luminescent image that has a varying luminescent effect. Moreover, the present invention provides a toy kit capable of providing a comprehensive luminescent effect.

BACKGROUND OF THE INVENTION

Conventional drawing boards, such as Etch-A-Sketch®, MagnaDoodle®, or LiteBright®, provide a writing/drawing surface allowing users to thereby serve amusement and education function to users, especially to children. However, such drawing boards can not be used in a dark environment because the images formed on the drawing boards cannot be seen without additional lighting aid.

Luminescent materials have been used to aid in the writing and reading in the dark. For example, U.S. Pat. No. 4,590,381 issued to Mendelson provides a phosphorescent marking system on which luminescent images are formed and retained for a period of time.

The present invention provides a luminescent device capable of forming a luminescent image having a varying luminescent effect. Additionally or alternatively, the present invention provides a writing/drawing toy kit capable of forming a luminescent image that has a varying luminescent effect so as to provide a comprehensive entertainment and education purpose.

SUMMARY OF THE INVENTION

The present invention provides a light-activated illuminating member comprising a support member and a phosphorescent material supported thereby. The support member and the phosphorescent material can form a luminescent image having a varying luminescent effect after the phosphorescent material is exposed to a light source. Various light sources, such as a UV-LED, can be used to activate the phosphorescent material.

According to one aspect of the present invention, one or more such light-activated illuminating members can be assembled with a light source, such as in the form of a UV-LED pen, to form a book-type writing/drawing toy. When a plurality of such illuminating members are used in the book-type toy, such a toy is capable of providing a comprehensive luminescent effect.

BRIEF DESCRIPTION OF THE DRAWINGS

The detailed description of the present invention will be better understood in conjunction with the accompanying drawings, wherein like reference characters represent like elements, as follows.

DETAILED DESCRIPTION OF THE INVENTION

Figure 1:
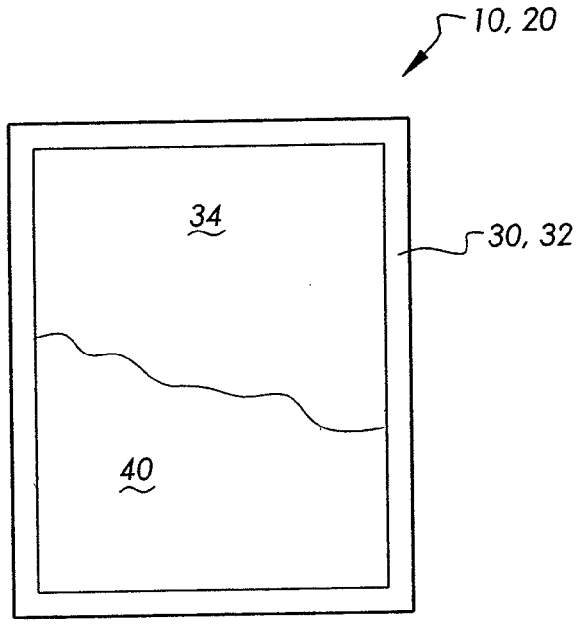
FIG. 1 shows a first embodiment of a light-activated illuminating member of the present invention.

Exemplary light-activated illuminating members and devices embodying the principles of the present invention are shown throughout the drawings and will now be described in detail. In the following description of the illuminating member and device, similar elements or components are designated with reference numbers having the same last two digits; redundant description is omitted.

The present invention provides a light-activated illuminating device 10, which can generally comprise a light-activated illuminating member 20. The illuminating member 20 can comprise a support member 30 that supports a phosphorescent material 40. The phosphorescent material 40, after being activated by a light source 50, is capable of forming a luminescent image, which can continue to glow for a period of time after the light source 50 is removed. In the present invention, the support member 30 and the phosphorescent material 40 are capable of forming a luminescent image that can have a varying luminescent effect after the light source is removed. In particular, such a varying luminescent effect can be achieved when the phosphorescent material 40 is directly exposed to an activating light of a uniform intensity.

The support member 30 can be formed in various manners. In one embodiment of the present invention, such as shown in FIG. 1, the support member 30 can be in the form of an enclosed container 32. The container 32 can be made of various materials that allow the phosphorescent material 40 to be exposed to a light source 50. For example, the container 32 can be made of a transparent material, such as vinyl. Additionally or alternatively, the container 32 can be formed in various shapes. In an exemplary embodiment, the container 32 can have a pair of parallel wall members 34. In another exemplary embodiment, the pair of wall members 34 can have a gap of about ⅛ inch therebetween. In a further exemplary embodiment, at least one of the wall members 34 can have a contoured shape, such as a square, circular, ball, star, or animal shape. It will be appreciated that various other materials or shapes of the container 32 and wall members 34 are also within the scope of the invention.

The phosphorescent material 40 can be supported by the support member 30 in various manners. For example, the phosphorescent material 40 can be in a particulate form. In one exemplary embodiment, such as shown in FIG. 1, the phosphorescent material 40 can be loosely held in or can otherwise freely flow inside the container 32. For example, the container 32 can be partially filled with the phosphorescent material 40 but left room for the phosphorescent material 40 to shift therein. In one exemplary embodiment, about half of the container 32 can be filled. In another exemplary embodiment, the phosphorescent material 40 can fill up to about three quarters of the container 32.

When the phosphorescent material 40 in the container 32 is activated, such as by a light source, to form an luminescent image, the initial pattern of the luminescent image can vary when the phosphorescent material 40 is caused to shift inside the container 32. Depending on the flow of the phosphorescent material 40 within the container 32, the initial pattern of the luminescent image formed can change into a series different patterns, after the light source is removed. The light-activated illuminating member 20 can provide a varying luminescent effect, similar to a kaleidoscope effect.

Various commercially available phosphorescent materials 40 can be used in the illuminating device 10 of the present invention. Exemplary phosphorescent materials can comprise zinc sulfide, zinc cadmium sulfide, and alkaline earth sulfides. In an exemplary embodiment, the phosphorescent material 40 can be a strontium aluminate. It will be appreciated that other types of the phosphorescent material 40 are also within the scope of the present invention.

Figure 2:
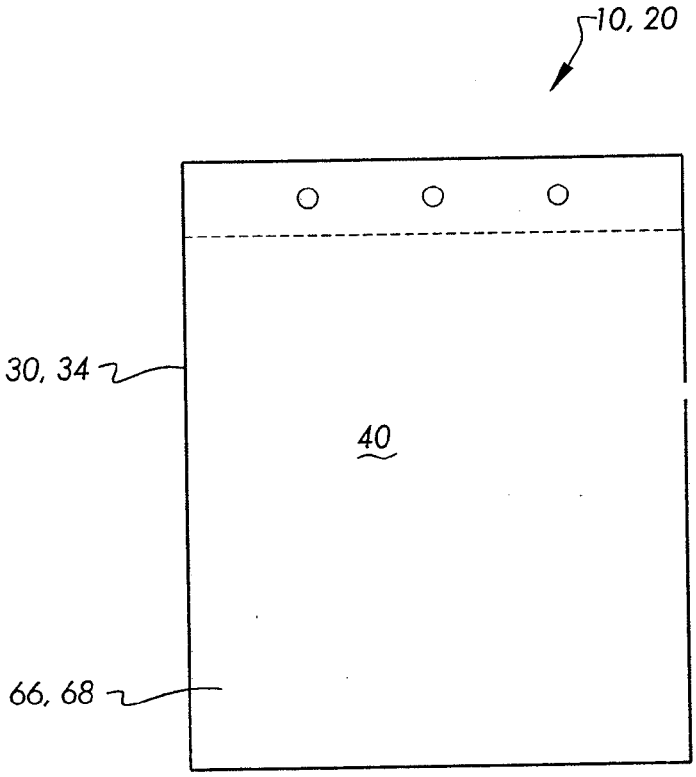
FIG. 2 shows a second embodiment of the light-activated illuminating member.
Figure 3:
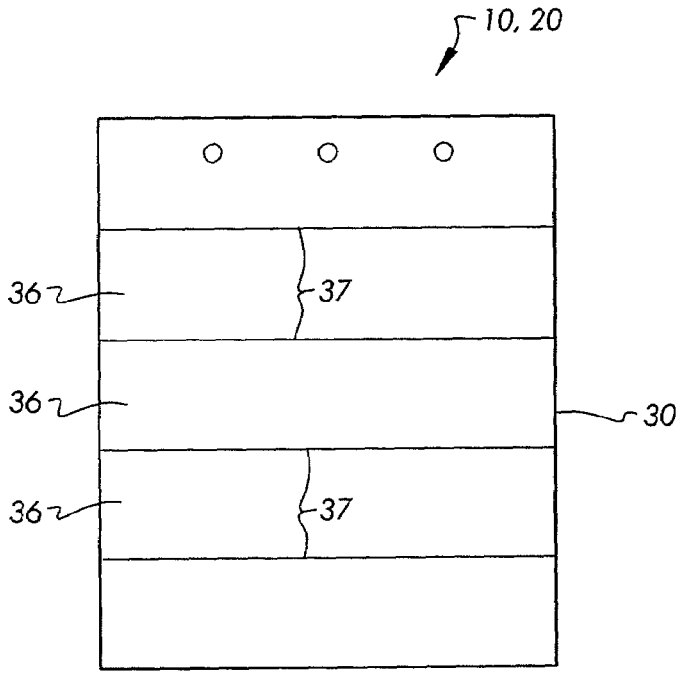
FIG. 3 shows a third embodiment of the light-activated illuminating member.
Figure 4:
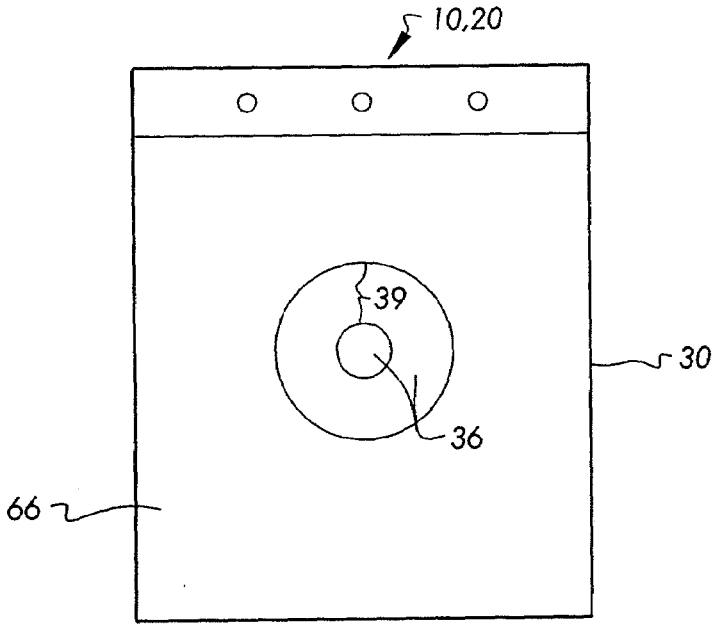
FIG. 4 shows a fourth embodiment of the light-activated illuminating member.

In another embodiment of the present invention, such as shown in FIGS. 2 to 4, the support member 30 can be in the form of a sheet member 34. The sheet member 34 can be formed in various materials or shapes to support the phosphorescent material 40. In one exemplary embodiment, the sheet member 34 can be formed as a writing/drawing board. In another exemplary embodiment, the sheet member 34 can be formed similar to a page in a children's book. If desired, the sheet member 34 can be adapted to join to another sheet member 34 and/or front and back cover members as described below. It will be appreciated that other material and shapes of the sheet member 34 are also within the scope of the present invention.

The sheet member 34 can be formed in various manners. For example, the sheet member 34 can comprise a plurality of sub-sections 36. In one exemplary embodiment, one or more of such sub-sections 36 can be formed in various patterns. For example, one or more sub-sections 36 can be formed as a designed pattern, such as a star, heart, ball, car, or animal shape, or a cartoon character. In an exemplary embodiment, such as shown in FIG. 3, the sub-sections 36 can formed by a plurality of parallel lines 37. In another exemplary embodiment, such as shown in FIG. 4, the sub-sections 36 can be formed by a plurality of concentric circles 39. It will be appreciated that other shapes of sub-sections 36 are also within the scope of the present invention.

The phosphorescent material 40 can be affixed onto one or both sides of the sheet member 34 in various manners. In one exemplary embodiment, the phosphorescent material 40 can be coated onto the sheet member 34. In another exemplary embodiment, the sheet member 34 can be sprayed with an adhesive material before the phosphorescent pigment 42 dusted onto the adhesive material. All excess phosphorescent pigment can be brushed off leaving a thin even layer of phosphorescent pigment 40 adhering to the sheet member 34. It will be appreciated that other methods for affixing the phosphorescent material 40 onto the sheet member 34 are also within the scope of the present invention.

In one exemplary embodiment, different types of phosphorescent materials 40 can be affixed onto the sheet member 34. For example, at least two different types of phosphorescent materials 40 can be affixed to at least two adjacent sub-sections 36 of the sheet member 34. In an exemplary embodiment, various sub-sections 36 can be affixed with phosphorescent materials 40 having different phosphor concentrations. Such phosphorescent materials 40 in the various sub-sections 36 can illuminate at different intensities, after the phosphorescent materials 40 are activated by a light source 50. For example, different phosphorescent materials 40 can be affixed to the various sub-sections 36 formed by concentric circles 39, such as shown in FIG. 4. After being exposed to a light source 50, the phosphorescent material 40 in a first sub-section 36*a* can illuminate at a different intensity from that in an adjacent sub-section 36*b*. The luminescent image so formed can thus have different illumination intensities. Accordingly to the present invention, the entire phosphorescent material 40 can be exposed to a light of a uniform intensity, while the resulting luminescent image can have a series concentric rings with different illumination intensities for a varying luminescent effect.

In another exemplary embodiment, at least two sub-sections 36 of the sheet member 34 can be affixed with phosphorescent materials 40 of different colors. For example, a first sub-section 36*a* can be affixed with a zinc sulfide and a second sub-section 36*b* can be affixed with a strontium aluminate. In another exemplary embodiment, the sheet member 34 can be covered with multi-colored phosphorescent pigments 40 for writing, doodling, painting etc. After the phosphorescent materials 40 are activated, the different sub-sections 36 can emit different colors. The luminescent image so formed can have a varying color pattern to achieve a varying luminescent effect. It will be appreciated that other methods for forming luminescent images with a varying luminescent effect are also within the scope of the present invention.

Figure 5:
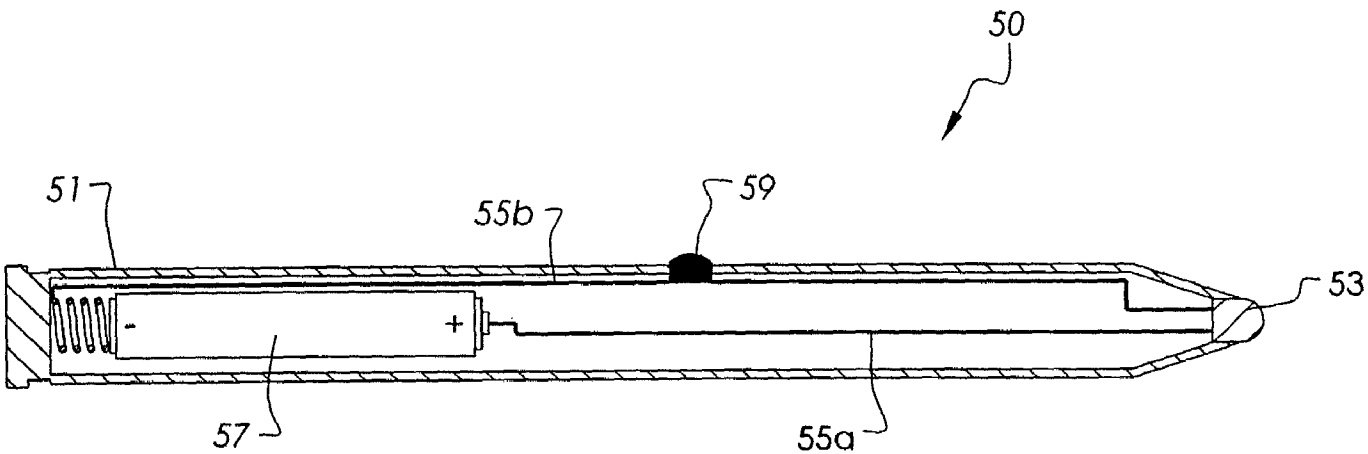
FIG. 5 shows an exemplary light source of a light-activated illuminating device of the present invention.

The light source 50 of the light-activated illuminating device 10 can be in various forms and capable of activating the phosphorescent material 40 to form a luminescent image. In one exemplary embodiment, the light source 50 can emit a UV-LED light. In another exemplary embodiment, the light source 50 can be made in a portable form, such as a pen or flashlight as shown in FIG. 5. In an exemplary embodiment as will be described in detail below, the light source 50 can be in the form of a ultra-violet LED pen.

In one exemplary embodiment, the UV LED pen 50 can comprise a pen shaped housing 51 with an ultra violet LED bulb 53. In an exemplary embodiment, the positive lead 55*a* from the bulb 53 can be connected directly to the positive lead of a battery 57. The neutral lead 55*b* is connected to one side of a momentary switch 59. The other side of the momentary switch 59 is connected to the negative side of the battery 57. Various commercially available batteries can be used in the light source 50. For example, the battery 57 can be a six volt battery. It will be appreciated that other materials and forms of the light source or the UV LED pen 50 are also within the scope of the present invention.

Figure 7:
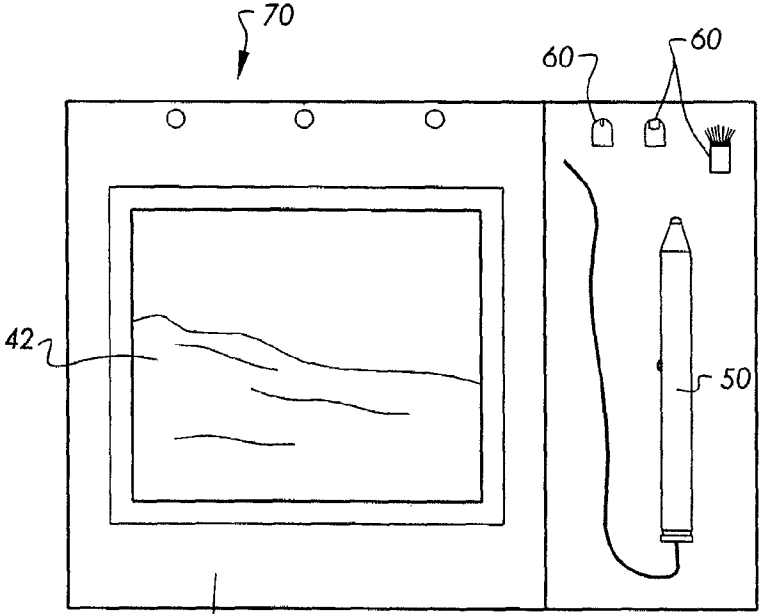
FIG. 7 shows an exemplary back cover of the toy kit.

In another exemplary embodiment, one or more light source adapters 60, such as shown in FIG. 7, can be provided to fit onto the UV LED bulb 53. The light source adapter 60 can change the shape of the light beams emitted from the light source 50. For example, the light source adapter 60 can have a narrow or wide outlet to allow the light beams to focus or expand. In one exemplary embodiment, the light source adapter 60 can have an outlet with a designed shape to thereby create luminescent images of a similar design. In another exemplary embodiment, the light source adapter 60 can comprise a brush tip for creating random fine lines. It will be appreciated that other materials and forms of the light source adapters 60 are also within the scope of the present invention.

Optionally, a protective member 66 can be used in connection with the sheet member 34 to shield the phosphorescent material 40 affixed thereon. The protective member 66 can prevent the phosphorescent material 40 from being directly accessed by a user. In an exemplary embodiment, the protective member 66 can be so formed to allow a light source to activate the phosphorescent material 40. For example, the protective member 66 can be a plastic film 68, such as a clear vinyl film. In an exemplary embodiment, the protective member 66 can overlay the sheet member 34 and at least partially be mounted thereto. In another exemplary embodiment, the protective member 66 can have a sleeve shape to surround the sheet member 34. It will be appreciated that other materials and forms of the protective member 66 are also within the scope of the present invention.

Figure 6:
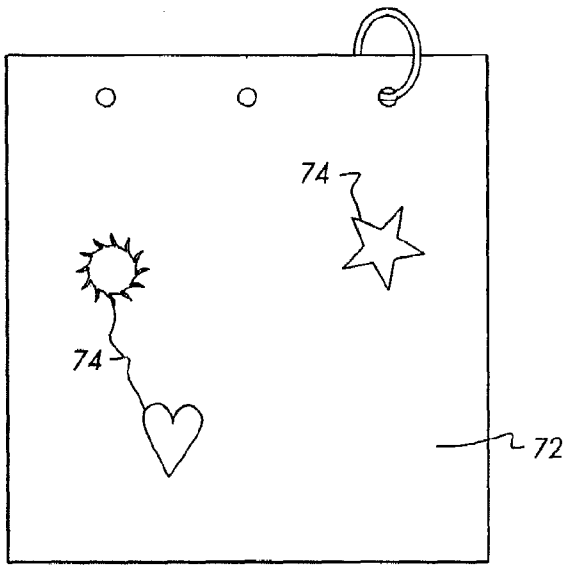
FIG. 6 shows an exemplary front cover of the toy kit of the present invention.

According to another aspect of the present invention, a writing/drawing toy kit 70 can be provided. In one embodiment, the writing/drawing kit 70 can be made in the form of a book comprising one or more light-activated illuminating members 20 for a user to write and/or draw on. In another exemplary embodiment, the writing/drawing kit 70 can comprise an ultra-violet LED pen 50, to allow a user to draw, write or otherwise create various luminescent images with high intensity glow results. In a further exemplary embodiment, the writing/drawing kit 70 can comprise a front and/or a back cover member 72, 80, such as shown in FIGS. 6 and 7. It will be appreciated that other forms of the writing/drawing kit 70 are also within the scope of the present invention.

In one exemplary embodiment, the front cover member 72 can be formed in various manners. For example, various materials can be used to form the front cover member 72. In an exemplary embodiment, the front cover member 72 can be made of a cardboard material, which can provide support for the writing/drawing kit 70 and/or prevent the light-activated illuminating member 20 from a light source 50. In another exemplary embodiment, the front cover member 72 can be made of a transparent material to show the color pattern on the light-activated illuminating member 20. Additionally or alternatively, the front cover member 72 can comprise various designs and/or color patterns. In an exemplary embodiment, the front cover member 72 can comprise one or more cut-out portions 74 in various shapes for a "try me" option on packaging. In another exemplary embodiment, the front cover member 72 can contain the product or trade name of the writing/drawing kit 70. It will be appreciated that other materials and forms of the front cover member 72 are also within the scope of the present invention.

In another exemplary embodiment, the back cover member 80 can be provided, which can be formed in various manners. In one exemplary embodiment, the back cover member 80 can be made in one of the various manners that the front cover member 72 is formed as described above. Additionally or alternatively, the back cover member 80 can be made slightly larger that the front cover member 72 to provide room for accommodating various accessories, such as the ultra-violet LED pen 50 and/or one or more light source adapters 60, such as shown in FIG. 7. It will be appreciated that other materials and forms of the back cover member 80 are also within the scope of the present invention.

The light-activated illuminating member 20, the front cover member 72, and/or the back cover member 80 can be assembled in various manners to provide a writing/drawing kit 70. In one exemplary embodiment, the light-activated illuminating member 20, the front cover members 72, and/or the back cover member 80 can be joined to one another through one or more rings, such as shown in FIG. 6. In another exemplary embodiment, the light-activated illuminating member 20 can be mounted onto the front cover member 72 or the back cover member 80, such as shown in FIG. 7.

In a further exemplary embodiment, one of the front cover member 72 and the back cover member 80 can be adapted to form a portion of the support member 30. For example, at least a portion of the back cover member 80 can be used to form the container 32, in which the phosphorescent pigment 42 is loosely held. In an exemplary embodiment, the back cover member 80 can substitute one of the two parallel wall members 34 of the container 32. In another exemplary embodiment, the back cover member 80 and the clear wall member 34 can have a gap of approximately ⅛ inch therebetween. The phosphorescent pigment 40 can be enclosed in the space between the back cover member 80 and the clear wall member 34. Similar to the light-activated illuminating member 20 described above, the writing/drawing kit 70 so formed can provide a luminescent image having a varying luminescent effect.

In another embodiment of the present invention, the writing/drawing kit 70 can comprise a plurality of light-activated illuminating members 20 that are in different forms. For example, the writing/drawing kit 70 can comprise a first light-activated illuminating member 20 as shown in FIG. 1 and a second light-activated illuminating member 20, such as one of those shown in FIGS. 2 to 4. In one exemplary embodiment, the writing/drawing kit 70 can be in the form of a book. The book 70 can comprise front and back cover members 72 and 80 and a plurality of book pages 20 for writing, doodling, painting, etc. For example, the book pages 20 can comprise a plurality of single colored pages of different colors and multiple colored pages in various patterns. The writing/drawing kit 70 can provide a luminescent image having a kaleidoscope effect as well as a luminescent image having a varying intensity or color pattern, thereby affording a comprehensive writing/drawing experience for the user.

The light-activated illuminating device 10 and the writing/drawing kit 70 of the present invention can be used for making toys, or for other education, entertainment, and novelty purposes.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications, and substitutions may be made therein without departing from the spirit of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive.

What is claimed is:

1. A light-activated illuminating device comprising a light source adapted to emit a light of a uniform intensity, a support member comprising an enclosed container and a phosphorescent material supported by the support member, wherein the light source emits a UV-LED light, wherein the container is a formed of a transparent vinyl material and comprises a pair of parallel wall members with a gap of ⅛ inch therebetween and wherein the support member and the phosphorescent material are so formed to provide a luminescent image that has a varying luminescent effect after the phosphorescent material is exposed to the light source.

2. The device of claim 1, wherein the phosphorescent material is loosely held in the enclosed container and can freely move therein;

whereby the luminescent image formed is variable in its pattern after the light source is removed.

3. The device of claim 1, wherein the container is half-filled with the phosphorescent material.

4. The device of claim 1, wherein at least one of the wall members has a contoured shape.

5. The device of claim 1, wherein the support member comprises a sheet member divided into a plurality of sub-sections, at least two adjacent sub-sections of the sheet member being coated with different phosphorescent materials.

6. The device of claim 5, wherein the sub-sections of the sheet member are coated with phosphorescent materials having different phosphor concentrations, whereby the luminescent image formed has a varying illumination intensity.

7. The device of claim 5, wherein the sub-sections of the sheet member are coated with different phosphorescent materials, whereby the luminescent image formed has a varying color effect.

8. The device of claim 5, wherein each sub-section is marked to distinguish from an adjacent sub-section.

9. The device of claim 1, wherein the phosphorescent material comprises a strontium aluminate.

10. A toy kit comprising:

a first light-activated illuminating member comprising a support member and a phosphorescent material supported thereby;

a first cover member for shielding the phosphorescent material from undesired exposure to light;

a second cover member, wherein the second cover member is joined to the first cover member and movable in relation thereto and a light source adapted to activate the phosphorescent material;

wherein the phosphorescent material is adapted to form a luminescent image that has a varying luminescent effect; and a second light-activated illuminating member affixed to the support member, which forms a luminescent image having a different luminescent effect from that of the first illuminating member.

11. The toy kit of claim 10, wherein the support member comprises an enclosed container; and the phosphorescent material is loosely held in the enclosed container and can freely move therein;

whereby the luminescent image formed is variable in its pattern after the light source is removed.

12. The toy kit of claim 10, wherein the first cover member comprises a countered cut-out portion.

13. The toy kit of claim 10, wherein the light source is a UV-LED pen.

14. The toy kit of claim 10 further comprising a plurality of tip adapters adapted to be mounted onto the light source to change the shape of light beams emitted from the light source.

* * * * *